US005566980A

United States Patent [19]

Fizer

[11] Patent Number: 5,566,980

[45] Date of Patent: Oct. 22, 1996

[54] MOTOR VEHICLE DOCUMENT ORGANIZER

[75] Inventor: John Fizer, P.O. Box 13772, Fort Wayne, Ind. 46865-3772

[73] Assignee: John Fizer, Fort Wayne, Ind.

[21] Appl. No.: 267,438

[22] Filed: Jun. 29, 1994

[51] Int. Cl.[6] ..... A45C 1/06; B42F 5/00

[52] U.S. Cl. ..... 281/31; 283/57; 283/58; 150/145; 150/146; 150/147

[58] Field of Search ..... 281/31; 283/57, 283/58; 206/37, 232; 150/147, 140, 138, 146, 145

[56] References Cited

U.S. PATENT DOCUMENTS 2,300,215 10/1942 Freifeld ..... 150/147 X
3,068,923 12/1962 Wolf ..... 150/145 X

FOREIGN PATENT DOCUMENTS 4117698 12/1992 Germany ..... 402/80 R

*Primary Examiner*—Frances Han

[57] ABSTRACT

A Motor Vehicle Document Organizer made of a flexible material with interior pockets designed specifically to house vehicle registration, proof of automobile insurance, accident information card, as well as a flap to secure driver's license for presentation. Motor Vehicle Document Organizer is foldable along a middle portion to form a front and rear cover. Interior pockets are affixed on three sides and unaffixed on the fold to accommodate insertion of said motor vehicle documents. Motor vehicle documents are commonly stored loosely in glove compartment of vehicle. This invention is particularly concerned with the organization and expedient identification of motor vehicle documents in a standardized format, eliminating timely searching for documents when requested by law enforcement or other emergency personnel.

2 Claims, 2 Drawing Sheets

MOTOR VEHICLE DOCUMENT ORGANIZER

BACKGROUND OF THE INVENTION

The present invention relates generally to a sheet of flexible material able to fold in the middle with interior pockets. More particularly, the present Motor Vehicle Document Organizer is adapted to house paper documents required by a licensed driver and stored in the glove compartment of an automobile for access when requested by law officials. Typically, drivers are left to their own means to organize motor vehicle documents, creating a situation a chaos when items are needed. Documents to be stored in organizer are to include, but not limited to, Certificate of Vehicle Registration, proof of automobile insurance, driver's license, and an accident information form.

In the prior art a variety of systems have been designed to house various items. This apparatus is designed specifically to organize and provide easy identification of motor vehicle documents. When required, the drivers need to quickly access all pertinent motor vehicle documents, is evident. Existing binders suffer from the disadvantage that they are not designed with compartments shaped to fit the size of motor vehicle documents. Since the present invention is bright in exterior color, and is stored is the automobile glove compartment, it is readily available. An advantage to a standardized housing for motor vehicle documents is that law enforcement or other emergency personnel have quick access to said important documents, at a time when every minute counts.

SUMMARY OF THE INVENTION

The present invention comprises a folded pouch with transparent interior pockets, particularly concerned with the organization of motor vehicle documents in a standardized manner.

The present invention consists of a pouch of flexible sheet material which is foldable along a middle portion to form a folder having a front cover and a rear cover, designed to organize motor vehicle documents in a standardized form. Standardization of document storage allows for expedient recognition and accessibility of motor vehicle documents.

The exterior of the folder forms a rectangle made of a flexible sheet material with a reinforcing seam on all four outer edges. This flexible sheet material provides a sturdy, protective cover for enclosed documents.

The exterior of the pouch is of a brightly colored flexible sheet material allowing for easy recognition and quick accessibility.

The interior of the folder consists of three separate pockets, varying in dimension to accommodate the size of each motor vehicle document. Each interior pocket is slightly larger in dimension than the document it is designed to house. Each pocket is formed by a panel of transparent flexible material affixed along three of its edges to the covers outer surface. The unaffixed edge allows for access into pocket to store motor vehicle documents and allows for removal of documents from pockets when needed. Transparent covering allow for protection and visibility of enclosed documents.

The top interior pocket is divided into two storage units, a left and a right, separated by a vertical seam.

The top right pocket is designed with two flaps to present a driver's license, with other motor vehicle documents when they are requested.

The top left pocket is designed to insert proof of automobile insurance.

The bottom pocket is designed to house certificate of vehicle registration and accident information form.

Thus, the object of the present invention is to provide a system for organizing motor vehicle documents in a standardized format.

A related object is to ensure that these documents are easily accessible when needed by the driver, such as a situation when requested by a law enforcement officer.

Yet another object of the present invention is to provide a system to prevent the loss or misplacement of motor vehicle documents.

Yet another object of the present invention is to produce a reinforced pocketed structure to allow protected handling of motor vehicle documents when a law enforcement officer is reading documents in a situation of inclement weather.

Yet another object of the invention is that in an accident situation, emergency personnel can gain quick access to pertinent information about the driver and their emergency contacts in an expedient manner.

A still further object of the present invention is the accident information form that is designed to help the motorist collect data on the accident at a stressful time.

These and other objects and advantages of the present invention will become apparent in the following descriptive sections.

BRIEF DESCRIPTION OF THE DRAWINGS

In the following drawings reference numerals have been used to indicate part of various views.

The drawings are for the purpose of illustration and description only and are not intended as a definition of the limits of the invention.

DETAILED DESCRIPTION OF INVENTION

Figure 1:
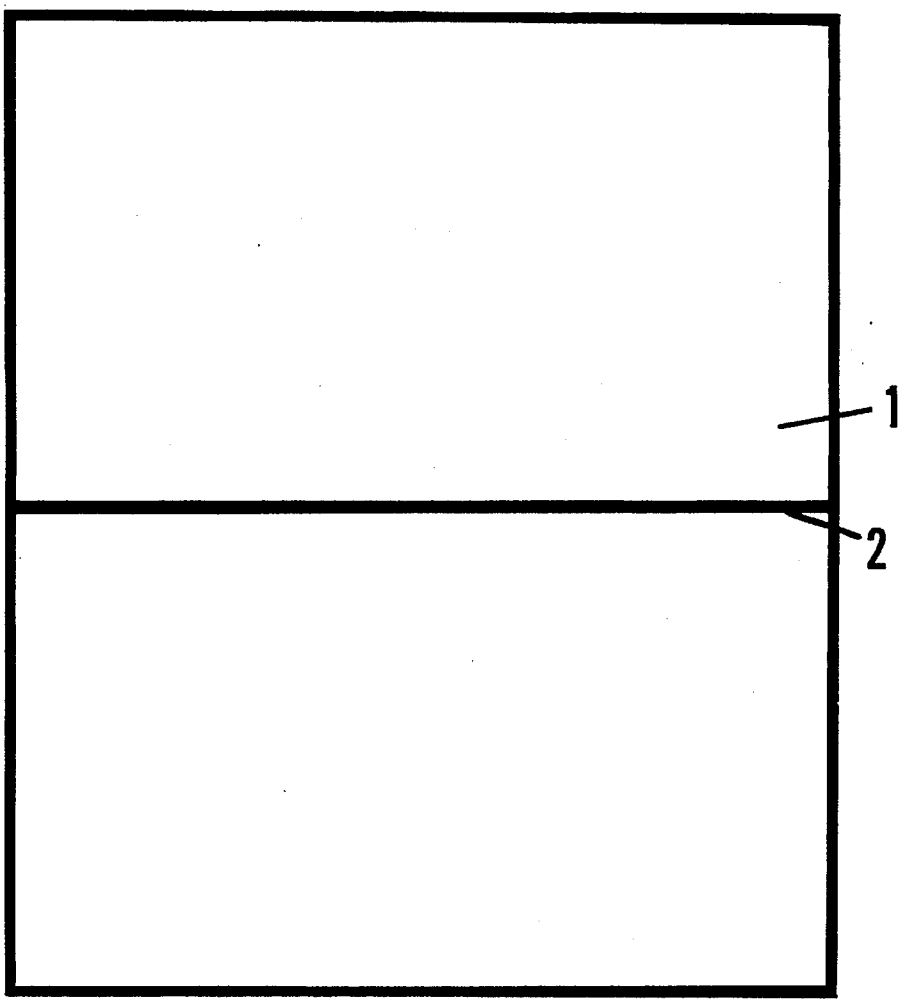
FIG. 1 is a plan view of the exterior of the invention shown in the unfolded position.

Turning now to FIG. 1, the Motor Vehicle Document Organizer is shown in the open position with full view of the exterior. The invention is adapted to organize motor vehicle documents in a standardized and easily recognizable manner. The system includes a sheet of flexible material 1 of a thickness strong enough to protect the documents. The folder has the capacity to fold in the middle as indicated by line 2.

Figure 2:
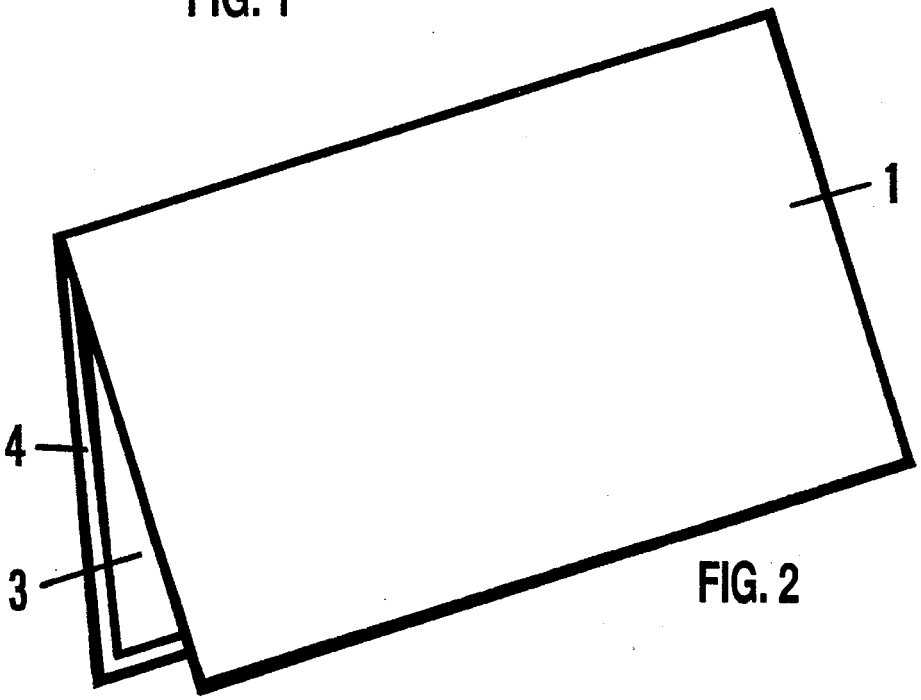
FIG. 2 is a plan view of the invention in a partially folded position, indicating a pocket and seam.

The organizer 1 is shown in the folded position (FIG.2) with partial view of bottom interior pocket 3. Pocket 3 is designed specifically to house an accident information card 13. The exterior material 1 is affixed to interior pockets 3, 6, and 9 by a fusion process creating seam 4.

Figure 3:
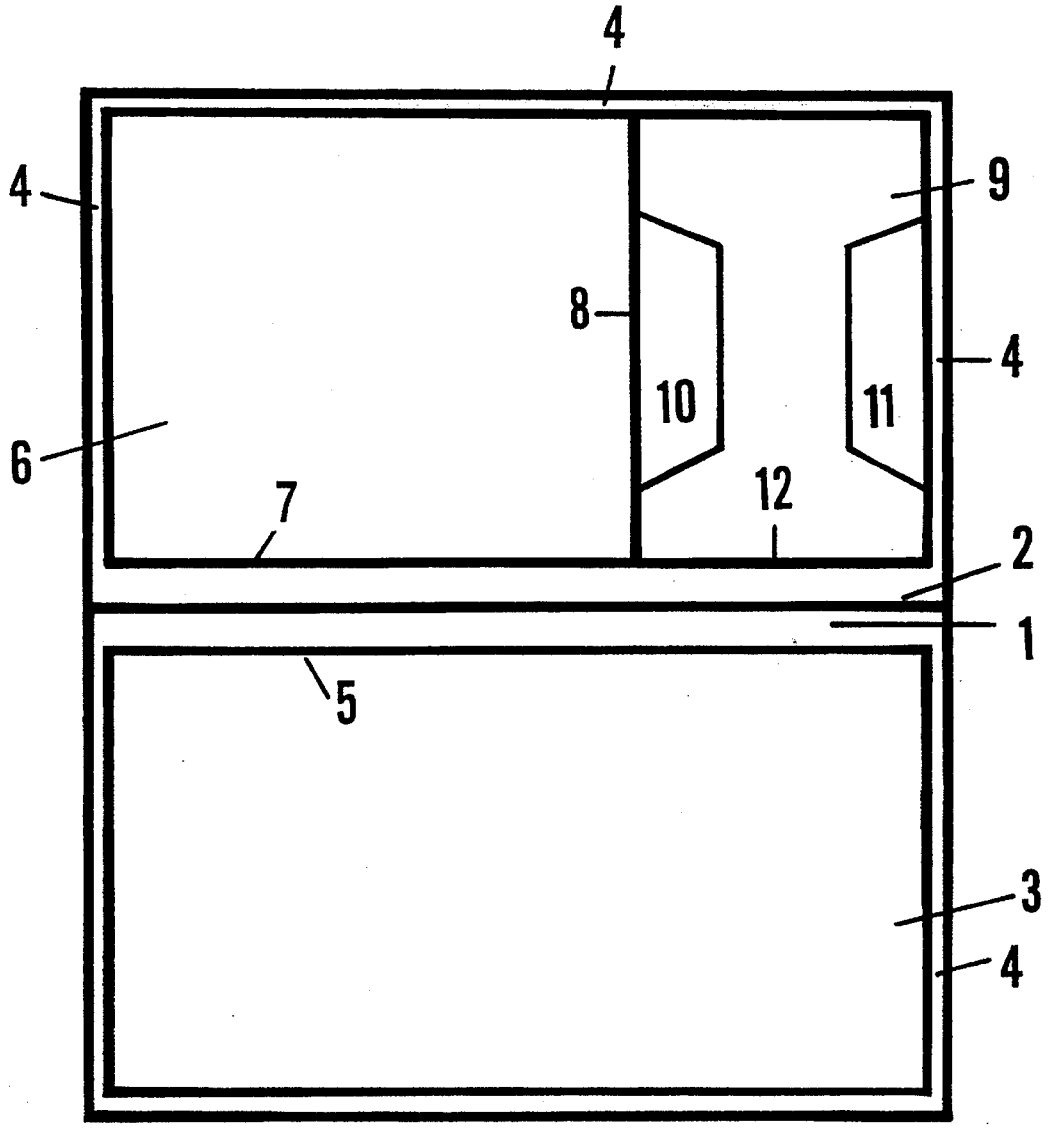
FIG. 3 is a plan view of the interior of the invention in the unfolded position indicating the 3 pockets and two flaps.

Turning now to FIG. 3 the Motor Vehicle Document Organizer is shown in full interior view. The interior side of reference numbers 1 and 2 are shown. Interior pockets 3, 6, and 9 are made of a transparent flexible material, allowing visibility of contained documents. Pocket 3 is secured on three sides by seam 4 and open of fold side 5 to allow for insertion of motor vehicle registration and accident information form 13. The top left pocket 6 is designed to house the driver's proof of automobile insurance card. Pocket 6 is secured on two sides by seam 4 and seam 8 on one side, then open along interior fold 2 at point of insertion 7. Top right pocket 9 is designed with a left flap 10 and a right flap 11 to secure driver's license temporarily when requested by police or other emergency personnel. Pocket 9 is secured on two sides by seam 4 and on one side by seam 8 and has an opening 12 along fold line 2. Flap 10 is secured by seam 8 and unsecured on the other three side. Flap 11 is secured by seam 4 and unsecured on the other three sides for temporary insertion of driver's license. Flaps 10 and 11 are created by a die cut from pocket 9.

Figure 4:
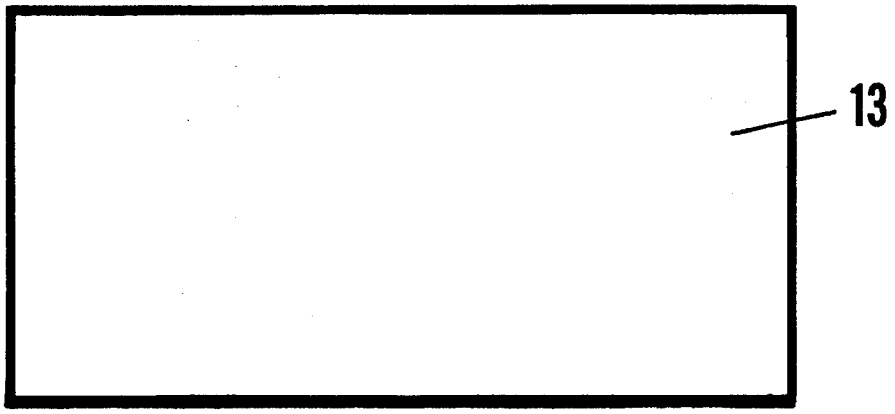
FIG. 4 is perspective view of the accident information form to be housed in bottom interior pocket.

FIG. 4 is a frontal detailing of the accident information form 13 to be housed in pocket 13 of Motor Vehicle Document Organizer. Form 13 is an information form to be filled out by driver at time of accident to assure details are recorded accurately for future use.

I claim:

1. A motor vehicle document organizer for storing in a glove compartment of a motor vehicle comprising:

an exterior of flexible material having a fold which defines a first panel and a second panel, an interior having first, second and third pockets formed by affixing transparent flexible material to the exterior, the first pocket affixed along three sides to the first panel, the second and third pockets each affixed along three sides to the second panel with a seam formed between the second and the third pockets and perpendicular to the fold, and a first flap and a second flap each cut in the transparent flexible material of the third pocket, the first flap attached to the flexible material at the seam and the second flap attached to the flexible material at an exterior edge of the second panel and parallel to the seam, the first and second flaps being adapted to receive and securely hold a motor vehicle document outside of the third pocket.

2. A motor vehicle document organizer as recited in claim 1, wherein:

the first, second and third pockets are open at the fold and the first pocket is larger than the second pocket and the second pocket is larger than the third pocket.

* * * * *